US010240856B2

(12) United States Patent
Park et al.

(10) Patent No.: US 10,240,856 B2
(45) Date of Patent: Mar. 26, 2019

(54) REFRIGERATOR

(71) Applicant: LG ELECTRONICS INC., Seoul (KR)

(72) Inventors: Ahreum Park, Seoul (KR); Younseok Lee, Seoul (KR); Junsoo Han, Seoul (KR); Yongjin Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 183 days.

(21) Appl. No.: 15/136,291

(22) Filed: Apr. 22, 2016

(65) Prior Publication Data

US 2016/0370105 A1 Dec. 22, 2016

(30) Foreign Application Priority Data

Jun. 16, 2015 (KR) ..... 10-2015-0084931

(51) Int. Cl.
*F25D 25/02* (2006.01)
*F25D 11/02* (2006.01)
(Continued)

(52) U.S. Cl.
CPC ..... *F25D 25/025* (2013.01); *F25D 11/02* (2013.01); *F25D 17/065* (2013.01);
(Continued)

(58) Field of Classification Search
CPC ..... F25D 25/025; F25D 17/065; F25D 11/02; F25D 2325/021; F25D 23/069; F25D 2317/061
(Continued)

(56) References Cited

U.S. PATENT DOCUMENTS 1,352,902 A * 9/1920 Kramer ..... E05B 65/0003 312/210
1,743,756 A * 1/1930 Charlton ..... B42F 17/02 220/551
(Continued)

FOREIGN PATENT DOCUMENTS

CA 2790447 A1 * 2/2014 ..... F25D 25/025
CA 2790447 A1 * 2/2014 ..... F25D 25/025
(Continued)

OTHER PUBLICATIONS

European Search Report dated Oct. 14, 2016 issued in Application No. 16167888.3.
(Continued)

*Primary Examiner* — Len Tran
*Assistant Examiner* — Kirstin U Oswald
(74) *Attorney, Agent, or Firm* — Ked & Associates, LLP

(57) ABSTRACT

A refrigerator may include a cabinet configured to form a storage compartment; a rear panel configured to form a rear wall of the storage compartment and have a cooling air outlet hole for discharging cooling air toward the storage compartment; a fan housing configured to couple to the rear panel and install a fan for generating a circulation of the cooling air therein; an outlet port configured to be formed in the fan housing and discharging the cooling air supplied by the drive of the fan; and a drawer configured to be withdrawn forward from an inside of the storage compartment. The drawer may include a drawer main body configured to form a storage space; a divider provided movably in the interior of the drawer main body and partitioning the storage space into a first space part and a second space part; and a sealer device configured to be provided on at least one side of the divider and sealing the first and second space parts each other.

18 Claims, 17 Drawing Sheets

(51) Int. Cl.
*F25D 17/06* (2006.01)
*F25D 23/06* (2006.01)

(52) U.S. Cl.
CPC ..... *F25D 23/069* (2013.01); *F25D 2317/061* (2013.01); *F25D 2325/021* (2013.01)

(58) Field of Classification Search
USPC ..... 62/407
See application file for complete search history.

(56) References Cited

U.S. PATENT DOCUMENTS 1,863,946 A * 6/1932 Smiley, Jr. ..... B42F 17/02 211/184
2,014,647 A * 9/1935 Feltault ..... A47J 43/1006 366/261
2,120,014 A * 6/1938 Bennett ..... F25D 25/025 109/84
2,124,511 A * 7/1938 Schmitz ..... B42F 17/02 220/542
2,156,955 A * 5/1939 Page ..... B42F 17/02 211/168
2,246,342 A * 6/1941 Brown ..... F25D 25/025 126/340
2,312,325 A * 3/1943 Earle ..... F25D 25/025 16/82
2,876,632 A * 3/1959 King ..... F25D 25/025 312/270.3
2,978,884 A * 4/1961 D Aleandro ..... F25D 17/08 62/413
2,992,057 A * 7/1961 Maxwell ..... A47B 88/43 312/332
3,020,733 A * 2/1962 Hubacker ..... F25D 17/065 62/122
3,029,357 A * 4/1962 Williams ..... A47B 88/9418 220/4.03
3,038,770 A * 6/1962 Kurens ..... A47B 47/02 312/221
3,075,366 A * 1/1963 Jung ..... F25D 17/065 62/285
3,241,334 A * 3/1966 Amore ..... F25D 25/021 62/382
3,350,899 A * 11/1967 Jones ..... F25D 17/065 62/340
3,364,694 A * 1/1968 Cohen ..... F25D 17/065 62/265
3,394,557 A * 7/1968 Kronenberger ..... F25D 17/065 62/176.6
3,466,891 A * 9/1969 Maxwell ..... F25D 17/065 62/419
3,600,905 A * 8/1971 Dymek ..... F25D 17/045 62/132
3,969,008 A * 7/1976 Pergler ..... E05B 65/464 312/221
4,326,390 A * 4/1982 Brooks ..... A23L 3/365 62/382
4,662,186 A * 5/1987 Park ..... F25D 17/045 62/265
4,850,206 A * 7/1989 Larsen ..... F25D 17/04 62/382
4,960,308 A * 10/1990 Donaghy ..... F25D 25/025 211/134
5,154,502 A 10/1992 Takaoka
5,211,461 A * 5/1993 Teufel ..... A47B 88/407 312/334.4
5,212,962 A * 5/1993 Kang ..... F25D 17/065 312/402
5,222,789 A * 6/1993 Yoshikawa ..... A47B 88/00 312/270.3
5,269,600 A * 12/1993 Arreola ..... A47B 88/90 211/184
5,312,180 A 5/1994 Tieder et al.
7,856,844 B2 * 12/2010 Kim ..... F25D 17/065 62/407
8,590,992 B2 * 11/2013 Lim ..... F25D 25/025 312/348.3
2004/0155564 A1 * 8/2004 Berger ..... A47B 88/90 312/348.3
2005/0061021 A1 * 3/2005 Uihlein ..... F25D 23/021 62/441
2005/0162050 A1 * 7/2005 Berger ..... A47B 88/994 312/108
2006/0260353 A1 * 11/2006 Uihlein ..... F25D 23/021 62/441
2007/0018548 A1 * 1/2007 Ertz ..... F25D 25/025 312/402
2009/0230832 A1 * 9/2009 Shin ..... F25D 25/025 312/404
2010/0319391 A1 12/2010 Lim et al.
2014/0152166 A1 * 6/2014 Baum ..... F25D 25/025 312/404
2014/0265802 A1 * 9/2014 Wilcox ..... F25D 25/025 312/404
2015/0102717 A1 * 4/2015 Furr ..... F25D 25/025 312/404

FOREIGN PATENT DOCUMENTS

CN 101731855 6/2010
CN 101929785 12/2010
CN 102472562 5/2012
CN 103673488 3/2014
CN 106016936 10/2016
EP 2792978 A2 * 10/2014 ..... F25D 23/069
EP 2792978 A2 * 10/2014 ..... F25D 23/069
JP 2015-055452 A 3/2015
KR 10-0570531 B1 4/2006
KR 10-2011-0109348 5/2013
KR 10-2015-0062662 A 6/2015

OTHER PUBLICATIONS

Korean Office Action issued in Application No. 10-2015-0084931 dated Feb. 29, 2016.
Chinese Office Action (with English translation) dated Jul. 20, 2018 issued in CN Application No. 201610384037.8.

* cited by examiner

REFRIGERATOR

CROSS-REFERENCE TO RELATED APPLICATION(S)

This application claims priority under 35 U.S.C. § 119 and 35 U.S.C. § 365 to Korean Patent Application No. 10-2015-0084931, filed in Korea on Jun. 16, 2015, whose entire disclosure is hereby incorporated by reference.

BACKGROUND

1. Field

A refrigerator is disclosed herein.

2. Background

Generally, a refrigerator may have a plurality of storage compartments which keep accommodated food frozen or refrigerated, and one surface of each of the storage compartments may be formed to be opened to put in or take out food. The plurality of storage compartments may include a freezer compartment which keeps food frozen and a refrigerator compartment which keeps food refrigerated.

A refrigeration system in which a refrigerant is circulated may be driven in the refrigerator. The refrigeration system may include a compressor, a condenser, an expander, and an evaporator. The evaporator may include a first evaporator provided at one side of the refrigerator compartment, and a second evaporator provided at one side of the freezer compartment. Cooling air stored in the refrigerator compartment may be cooled while passing through the first evaporator, and the cooled air may be supplied again into the refrigerator compartment. The cooling air stored in the freezer compartment may be cooled while passing through the second evaporator, and the cooled air may be supplied again into the freezer compartment.

A drawer which forms a storage space for accommodating the food may be provided at or in the refrigerator. The drawer may be provided to be withdrawn from a main body of the refrigerator. A device which divides the storage space of the drawer may be provided at or in the drawer.

A drawer as described above is disclosed in Korean Patent Application Number: KR 10-2011-0109348 (Oct. 25, 2011), whose disclosure is hereby incorporated by reference in its entirety. The above-mentioned related art discloses a technical spirit in which a partition which divides a storage space of the drawer is provided, and a partitioning size of the storage space may be changed according to a size of the food. The related art has described only the spirit in which sizes of a plurality of spaces having the same temperature condition are changed, and the temperature of each of the divided storage spaces may not be independently controlled. The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
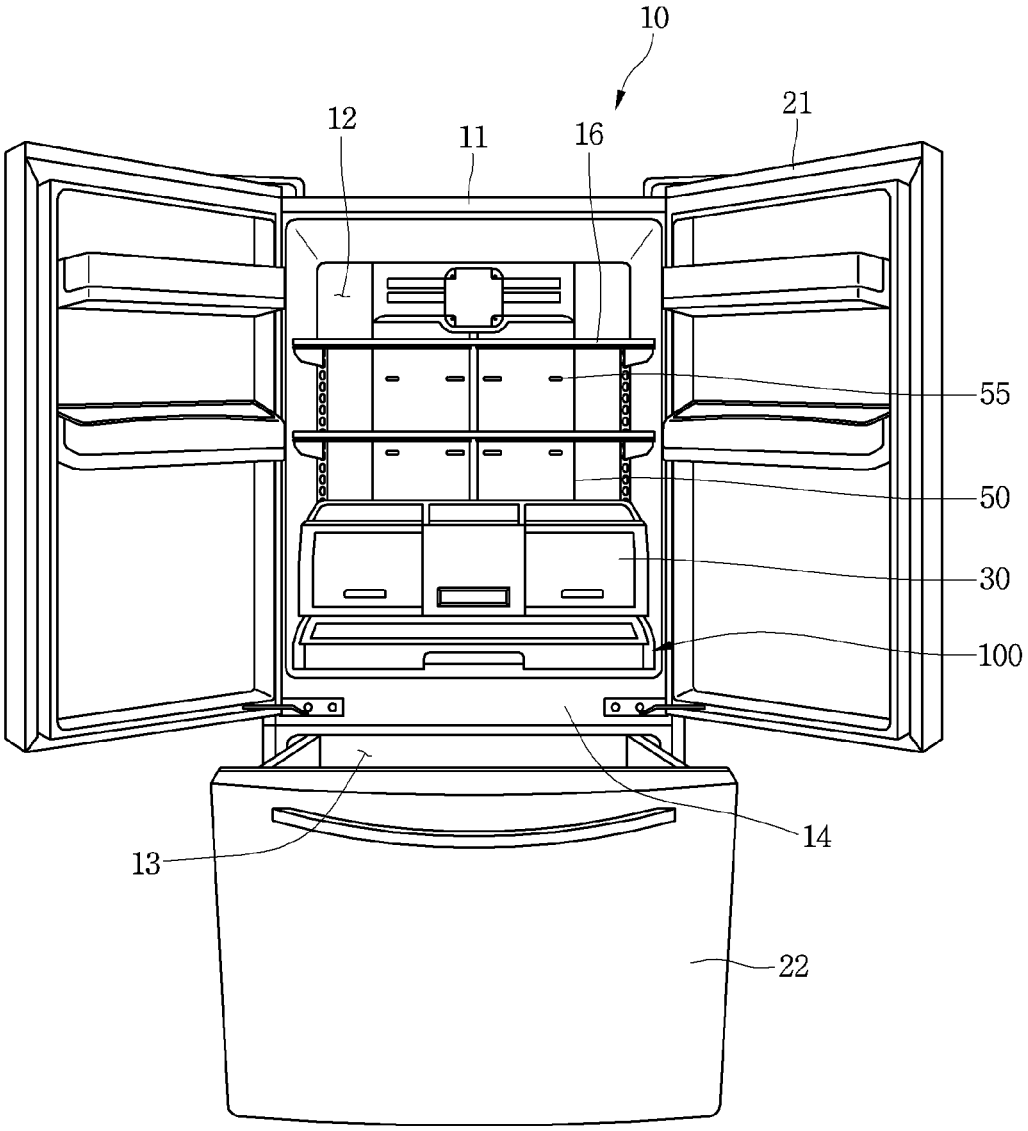
FIG. 1 illustrates a configuration of a refrigerator according to an embodiment.
Figure 2:
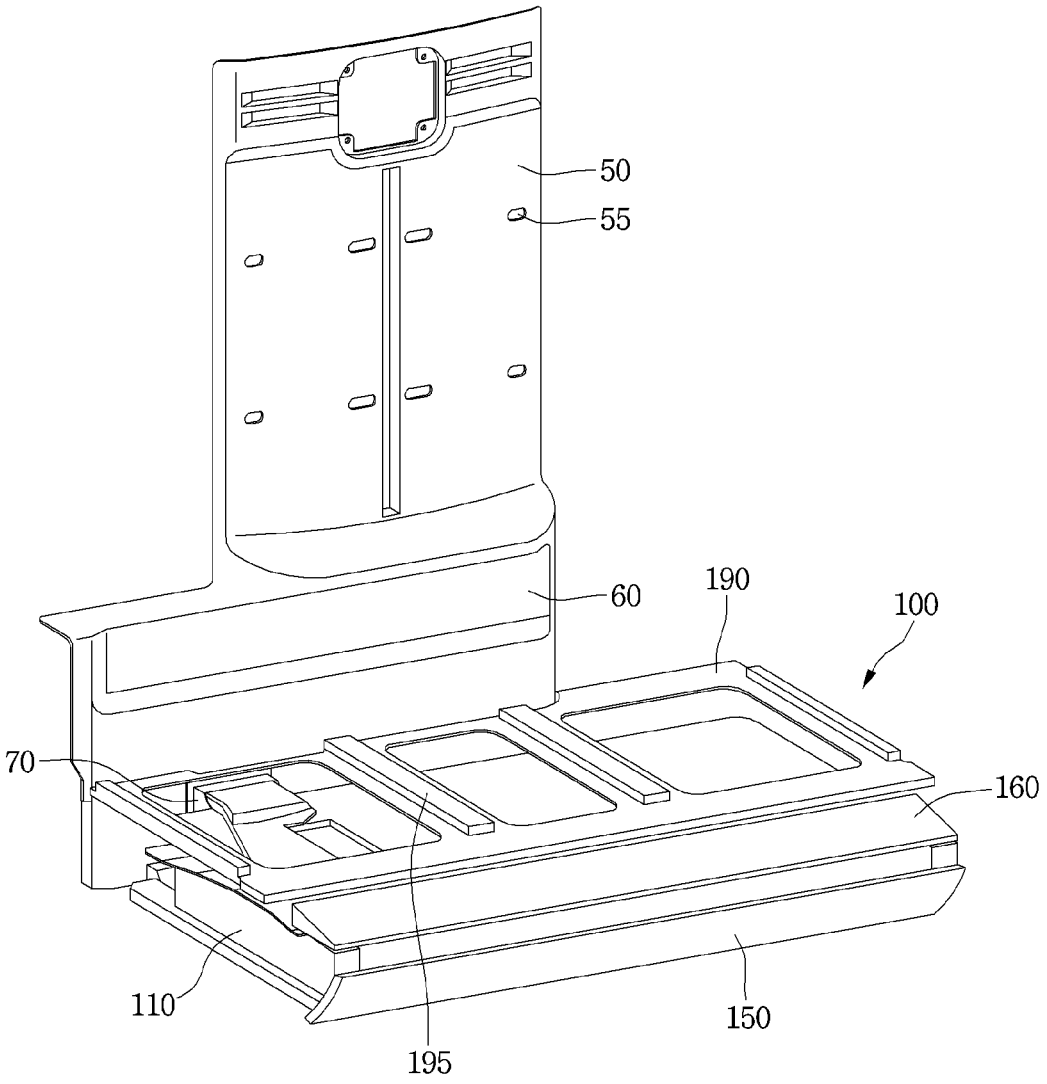
FIG. 2 illustrates a partial configuration of the refrigerator according to an embodiment.

Referring to FIGS. 1 to 4, a refrigerator 10 may include a cabinet 11 which forms storage spaces 12 and 13, and doors 21 and 22 which shield an open front surface of the cabinet 11. The storage spaces 12 and 13 may include a refrigerator compartment 12 which keeps food refrigerated, and a freezer compartment 13 which keeps food frozen. The refrigerator compartment 12 may be formed at an upper side of the freezer compartment 13. The refrigerator 10 may further include a partition part 14 which divides the refrigerator compartment 12 and the freezer compartment 13. The partition part 14 may be provided between the refrigerator compartment 12 and the freezer compartment 13.

The doors 21 and 22 may include a refrigerator compartment door 21 which opens and closes the refrigerator compartment 12, and a freezer compartment door 22 which opens and closes the freezer compartment 13. The refrigerator compartment door 21 may be rotatably coupled to a front of the cabinet 11, and two refrigerator compartment doors 21 may be provided at both sides thereof.

The freezer compartment door 22 may be provided to be withdrawn forward. A basket which stores the food may be coupled to a rear side of the freezer compartment door 22. The basket may be withdrawn forward together with the freezer compartment door 22 or may be inserted into the freezer compartment 13.

The refrigerator 10 may further include a multi-duct 50 forming a rear wall of the refrigerator compartment 12 and having a cooling air outlet hole 55 through which cooling air generated at an evaporator may be discharged to the refrigerator compartment 12. The multi-duct 50 may be a cooling air supply path for a refrigerator compartment, and a plurality of cooling air outlet holes 55 may be formed. The cooling air discharged to the refrigerator compartment 12 through the plurality of cooling air outlet holes 55 may cool the refrigerator compartment 12 while being circulated in the refrigerator compartment 12.

The refrigerator 10 may further include a vegetable box 30 which stores vegetables. The vegetable box 30 may be provided to be withdrawn forward, and a plurality of vegetable boxes 30 may be horizontally provided. As illustrated in FIG. 1, three vegetable boxes 30 may be installed. A drawer 100 having a plurality of storage spaces having different temperatures from each other may be installed under the vegetable boxes 30. The drawer 100 may be provided to be withdrawn forward.

The drawer 100 may be installed between the vegetable boxes 30 and the partition part 14, and a lower surface of the drawer 100 may be located on an upper surface of the partition part 14. A guide device which guides movement of the vegetable boxes 30 may be installed on an upper surface of the drawer 100. A direction that the freezer compartment door 22 or the drawer 100 is withdrawn may be defined as a front, and an opposite direction may be defined as a rear. A direction that the two refrigerator compartment doors 21 are arranged in parallel may be defined as a horizontal direction.

The refrigerator 10 may include a rear panel 60 which extends to a lower side of the multi-duct 50, and forms a part of the rear wall of the refrigerator compartment 12. The rear panel 60 may be integrally formed with the multi-duct 50, or may be formed as a separate panel member, and then may be coupled to the multi-duct 50.

The evaporator may act as a heat exchanger which generates the cooling air and may be installed at a rear side of the multi-duct 50 and the rear panel 60. At least a portion of the cooling air generated at the evaporator may be introduced into the refrigerator compartment 12 through the cooling air outlet hole 55, and another portion of the cooling air may be introduced into the storage space of the drawer 100.

Figure 5:
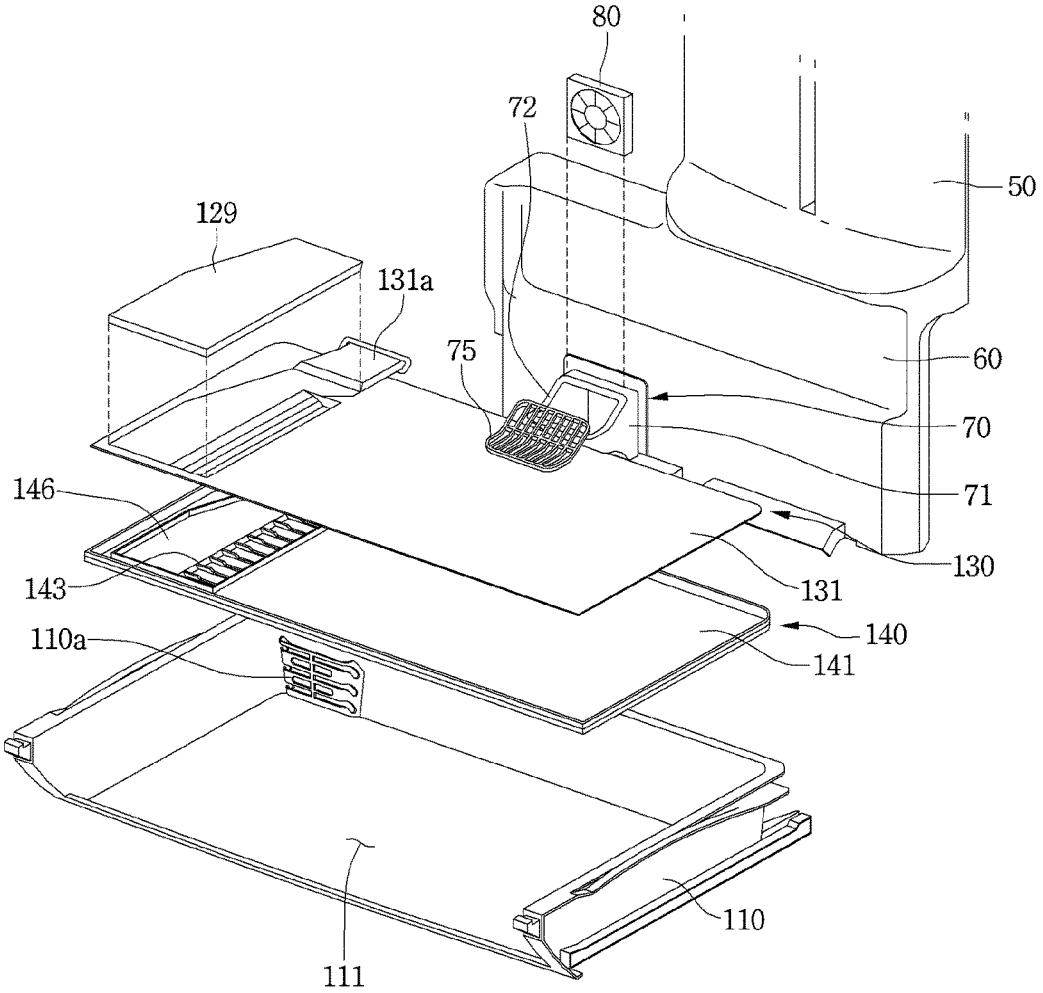
FIG. 5 is an exploded perspective view illustrating a configuration of the drawer according an embodiment.
Figure 6:
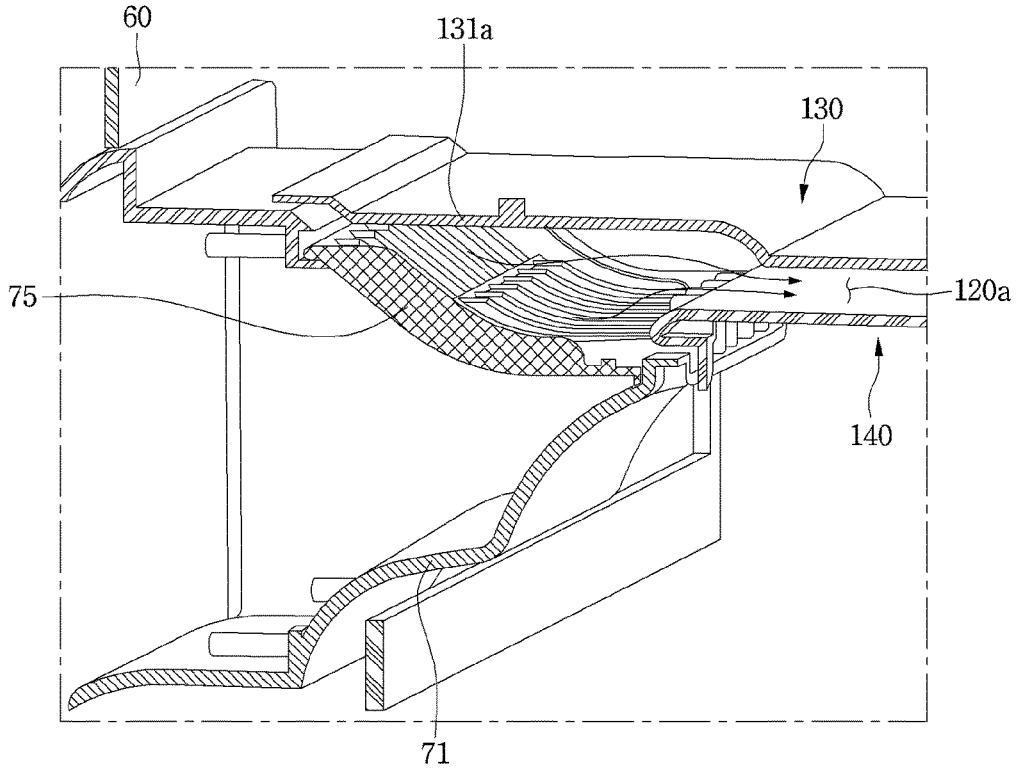
FIG. 6 is a cross-sectional view illustrating configuration of a fan housing and a cooling air duct according to an embodiment.
Figure 7:
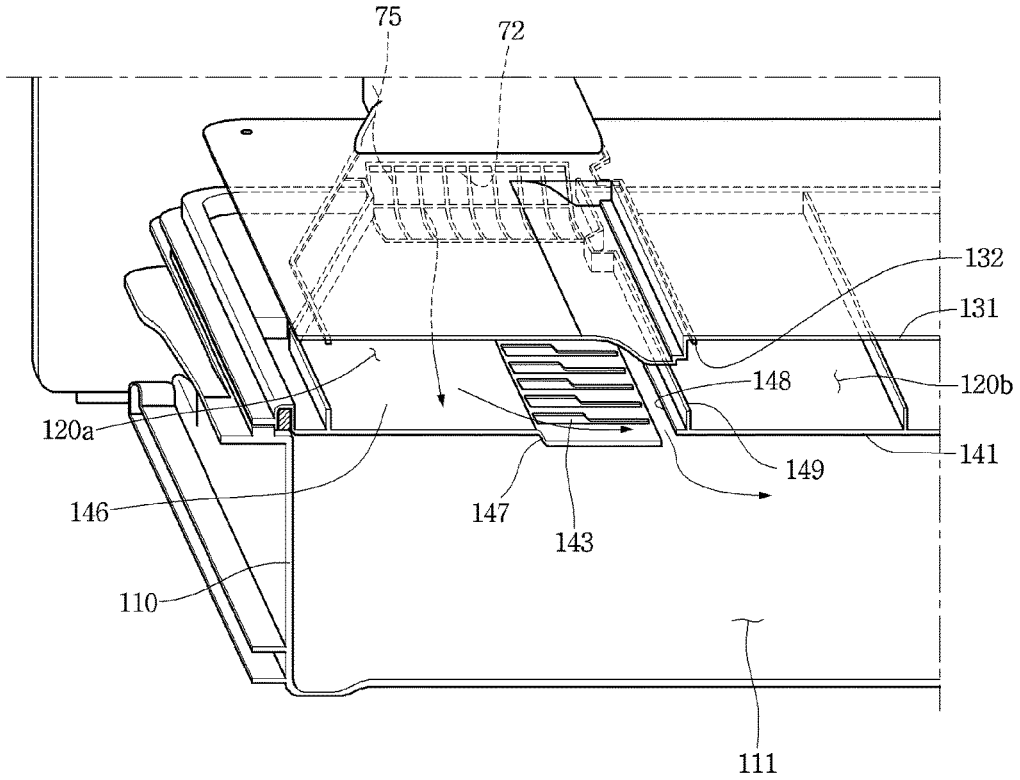
FIG. 7 is an exploded cross-sectional view illustrating a configuration of a cooling air path of the drawer according to an embodiment.
Figure 8:
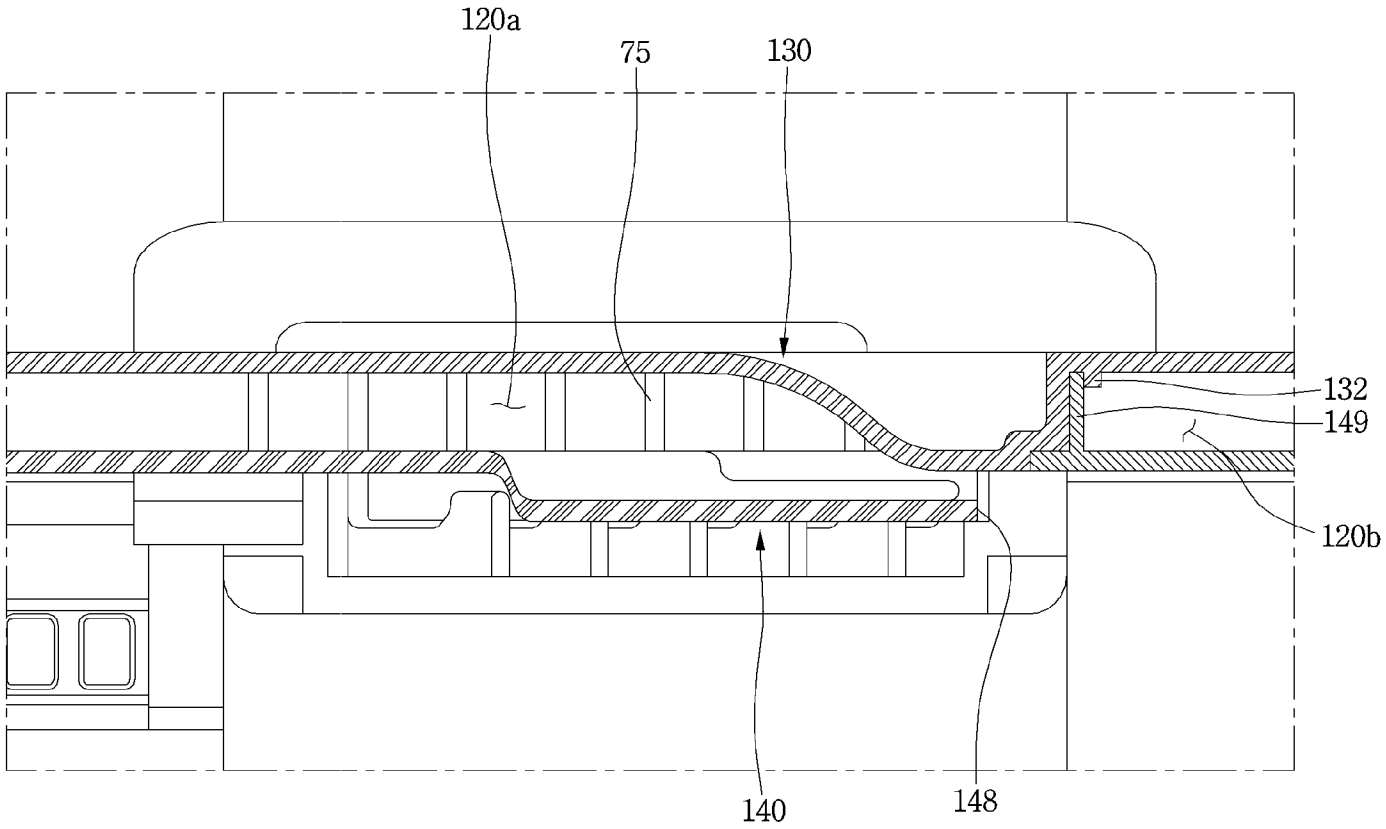
FIG. 8 is a cross-sectional view illustrating a configuration of the cooling air path of the drawer according to an embodiment.
Figure 9:
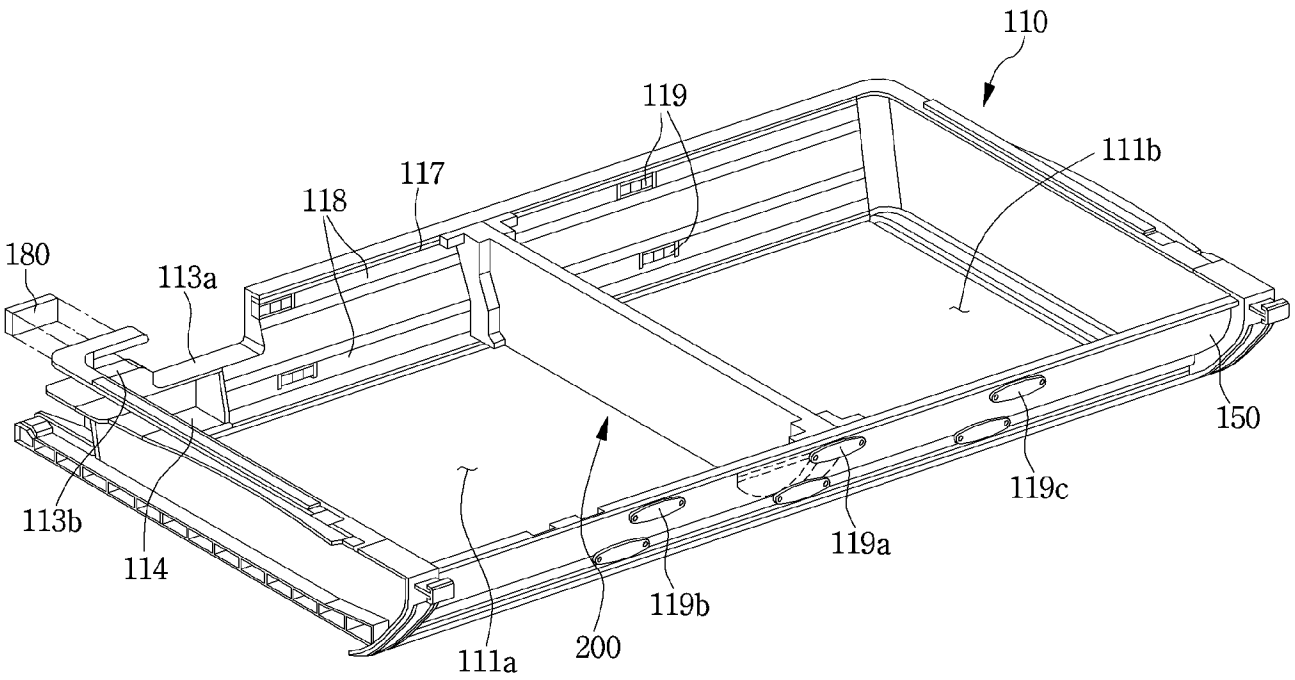
FIG. 9 illustrates a divider being installed in a drawer main body according to an embodiment.

A fan housing 70 which accommodates a fan 80 (referring to FIG. 5) may be provided at one side of the rear panel 60. The fan housing 70 may be coupled to a front side of the rear panel 60. An outlet port 72 through which the cooling air passed through the fan 80 may be discharged may be formed at the fan housing 70. The outlet port 72 may be in communication with the drawer 100, and the cooling air discharged from the outlet port 72 may be supplied into a storage space 111 of the drawer 100.

The drawer 100 may be coupled to a front of the fan housing 70. The drawer 100 may include a drawer main body 110 which forms the storage space 111 and may be provided to be withdrawn or inserted, a cooling air duct 120 which shields at least a part of an open upper portion of the drawer main body 110 and forms a path through which the cooling air passed through the fan 80 flows, and a duct support part 190 which may be provided at an upper side of the cooling air duct 120 and supports the cooling air duct 120.

Upper and front portions of the drawer main body 110 may be formed to be opened. Further, the duct supporting part 190 may be a fixed configuration at one position. The cooling air duct 120 may be a cover member that shields the drawer main body 110, and may be provided to be movable upward or downward. While the drawer main body 110 is inserted, the cooling air duct 120 may be moved downward by its own weight and may be in close contact with an upper surface of the drawer main body 110. In a process of withdrawing the drawer main body 110, the cooling air duct 120 may open the drawer main body 110 while moving in the upward direction.

Figure 3:
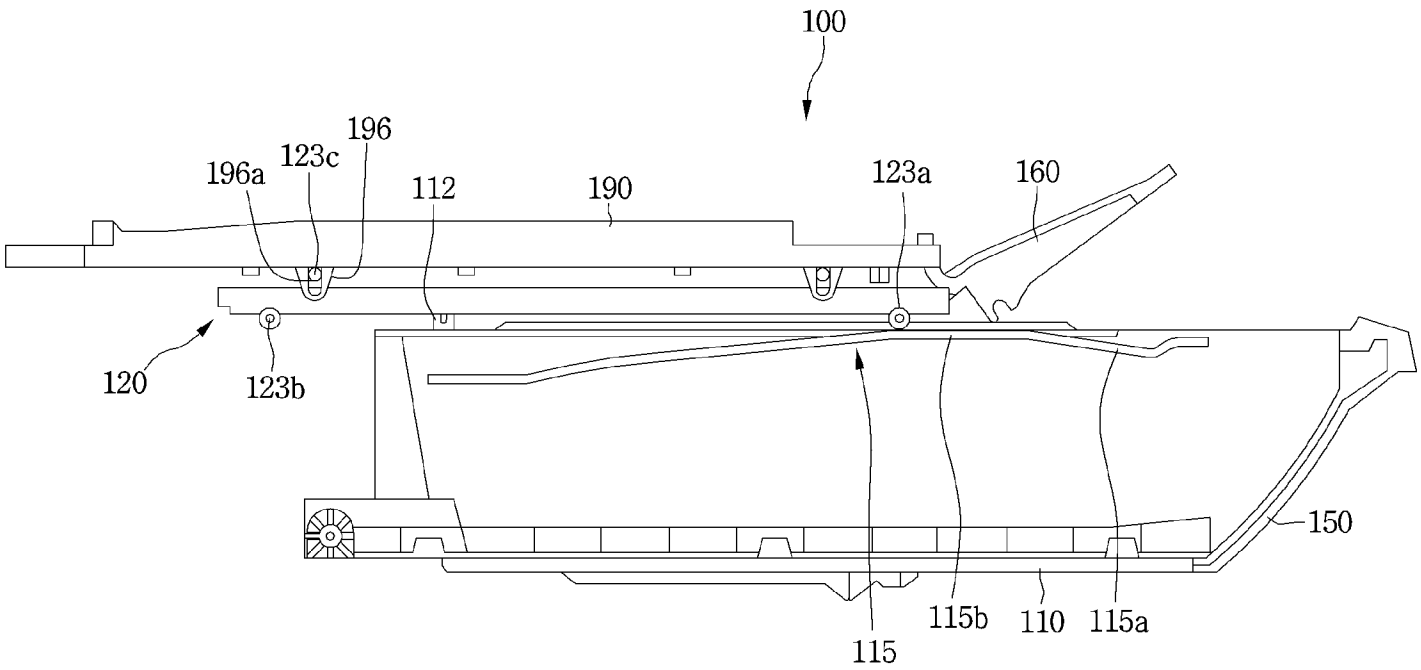
FIG. 3 illustrates an open state of a drawer according an embodiment.
Figure 4:
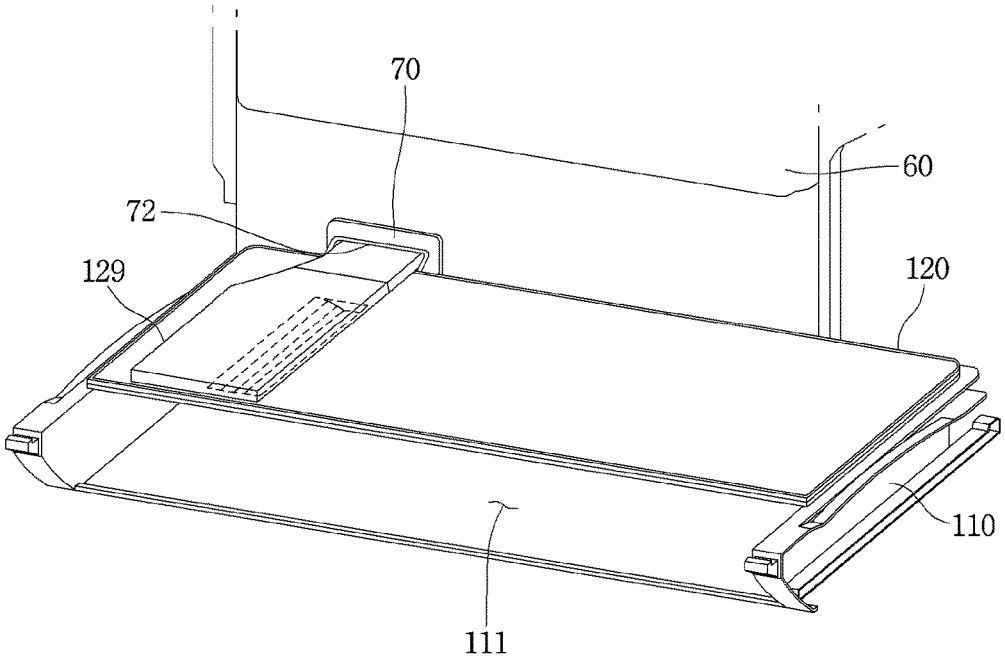
FIG. 4 illustrates a partial configuration of the drawer according to an embodiment.

Referring to FIG. 3, a duct guide 115 for guiding movement of the cooling air duct 120 may be provided on a side surface of the drawer main body 110. The duct guide 115 may include a plurality of guides each formed at a different height. The plurality of guides may include a first guide 115*a* which extends obliquely downward toward the front and a second guide 115*b* extending to the rear from the first guide 115*a* and provided in a relatively high position compared to the first guide 115*a*. That is, the first guide 115*a* may be extended obliquely downward toward the front from the second guide 115*b*.

A guide supporting part 123*a* supported by the duct guide 115 may be provided in a front lower portion of the cooling air duct 120. The guide supporting part 123*a* may be supported approximately in a center portion of the first guide 115*a* when the drawer main body 110 in an inserted position, and accordingly the cooling air duct 120 may be moved downward. In the process of withdrawing the drawer main body 110, the guide supporting part 123*a* may be supported on the second guide 115*b* and accordingly the cooling air duct 120 may be moved upward.

A first projection 123*b* coupled to a projection coupling part (or projection coupler) 112 of the drawer main body 110 may be provided in a rear lower portion of the cooling air duct 120. When the drawer main body 110 is inserted, the first projection 123*b* may be coupled to the projection coupling part 112. In contrast, the first projection 123*b* may be separated from the projection coupling part 112 while the drawer main body 110 is withdrawn, and the projection coupling part 112 may support a lower surface of the cooling air duct 120. The projection coupling part 112 may be provided in a rear upper portion of the drawer main body 110.

The second projection 123*c* may be provided in front and rear upper portions of the cooling air duct 120. While the cooling air duct 120 is moved upward or downward, a supporting guide part (or supporting guide) 196 for guiding movement of the second projection 123*c* may be provided in a lower portion of the duct supporting part 190. A insertion hole 196*a* into which the second projection 123*c* is inserted may be formed in the supporting guide part 196. The second projection 123*c* may be provided movably inside the supporting guide part 196.

When the drawer main body 110 is inserted, the second projection 123*c* may be located in a lower portion of the insertion hole 196*a* of the supporting guide part 196. When the drawer main body 110 is withdrawn, the second projection 123*c* may be located in an upper portion of the insertion hole 196*a* of the supporting guide part 196.

A guide device guiding the withdrawal of the vegetable box 30 may be included in the duct supporting part 190. The guide device may include a guide rail 195 extending in a front and rear direction on a top surface of the duct supporting part 190. A plurality of guide rails 195 may be provided corresponding to the number of the vegetable boxes 30, and the vegetable box 30 may be withdrawn forward along the guide rail 195.

The drawer 100 may further include a top cover 160 shielding a front upper portion of the drawer main body 110, and a front cover 150 shielding an open front portion of the drawer main body 110. When the drawer main body 110 is withdrawn, a front portion of the front top cover 160 may be rotated around a hinge at the rear. An air buffer layer may be formed in the cooling air duct 120, the top cover 160 and front cover 150. An insulating effect may be improved due to the air buffer layer.

Referring to FIGS. 5 to 8, the fan housing 70 may include a housing main body 71 having a path which protrudes forward from the rear panel 60 and guides the flow of cooling air to the inside. In an upper portion of the housing main body 71, the outlet port 72 through which the cooling air passed through the fan 80 is discharged may be formed. The fan 80 may be installed in an inner space of the fan housing main body 71.

A housing cover 75 may be installed at the outlet port 72. The refrigerant discharged through the outlet port 72 may flow through the housing cover 75 to the cooling air duct 120. For a smooth flow of the cooling air, the housing cover 75 may be configured in a mesh shape. The configuration of the housing cover 75 may prevent a user from putting his or her hand into the inside of the outlet port 72.

The cooling air duct 120 may be a cover member shielding the upper portion of the drawer main body 110. The cooling air duct 120 may include a first cover 130 and a second cover 140 coupled to a lower side of the first cover 130. A cooling air path 120*a* through which the cooling air discharged from the outlet port 72 flows and an air bound (or air buffer layer) 120*b* through which air is inserted for insulating may be included between the first cover 130 and the second cover 140.

The cooling air path 120*a* and the air bound 120*b* may be divided by coupling parts 132 and 149 coupled to each other. The coupling parts 132 and 149 may include a first coupling part (or a first coupler) 132 provided on a lower surface of the first cover 130 and a second coupling part (or a second coupler) 149 provided on an upper surface of the second cover 140. The first and second coupling parts 132 and 149 may be named as a path partition part (or path partition).

When the first and second covers 130 and 140 are assembled, a side of the first coupling part 132 may be supported on a side of the second coupling part 149 and may separate the cooling air path 120*a* and the air bound 120*b*. The first cover 130 may include a first cover main body 131 having an approximately rectangular shaped panel and a cover 131*a* for covering the outlet port 72 of the fan housing 70. The cover 131*a* corresponding to a shape of the outlet port 72 may be placed on a rear portion side of the first cover main body 131 corresponding to the position of the outlet port 72. The cover 131*a* may guide the cooling air discharged from the outlet port 72 to the cooling air path 120*a* between the first and second covers 130 and 140.

The first coupling part 132 may be projected downward from a lower surface of the first cover main body 131, and the second coupling part 149 may be inserted between one portion of the first cover main body 131 and the first coupling part 132. The second cover 140 may include a second cover main body 141 having a rectangular panel shape, corresponding to a shape of the first cover main body 131, a guide surface 146 which is provided in an upper portion of the second cover main body 141 and guides the flow of cooling air discharged from the outlet port 72, and a plurality of ribs 143 provided on one side of the guide surface 146.

The guide surface 146 may form a flat upper surface of the second cover main body 141 and the plurality of ribs 143 may be provided to protrude upward from the upper surface of the second cover main body 141. The plurality of ribs 143 may be provided at a front of the outlet port 72, and the guide surface 146 may be provided at a side of the plurality of ribs 143. The plurality of ribs 143 may serve as a blocking part which relatively blocks the flow of the cooling air discharged from the outlet port 72. The cooling air may bypass the plurality of ribs 143, and may flow toward the guide surface 146.

If the cooling air discharged from the outlet port 72 flows straight forward and then is immediately introduced into the drawer main body 110, the cooling air may not be circulated in the storage space 111 of the drawer main body 110, and instead may be immediately discharged through an inlet port 114 of the drawer main body 110. By providing the plurality of ribs 143, the cooling air does not flow straight forward, but may be introduced in a predetermined arc into the drawer main body 110.

An insulator 129 may be provided for preventing condensation caused by the cooling air path 120*a* in the second cover 140. The insulator 129 may be provided on an upper side of the second cover main body 141, and may be arranged on an upper side of the cooling air path 120*a* at the locations corresponding to the cooling air path 120*a*. When the insulator 129 is provided, the condensation and dew resulting from the inside and outside temperature difference of the cooling air path 120*a* may be prevented.

Referring to FIGS. 5 to 9, the inlet port 114 may be formed on a rear surface of the drawer main body 110. A suction guide 110*a* which guides the flow of cooling air that flows into the inlet port 114 may be provided in front of the inlet port 114. Cooling air of a first space part (or first space) 111*a* may be sucked into the inlet port 114 through the suction guide 110*a* and flow to the evaporator.

The first space part 111*a* is understood as a space divided by a divider 200 of the storage space 111 of the drawer main body 110. The storage space 111 may include the first space part 111*a* formed at a first side of the divider 200 and a second space part (or second space) 111*b* formed at a second side of the divider 200.

The second space part 111*b* may be defined by the drawer main body 110 and the divider 200 and may be understood as a space that can be closed to the outside. The first space part 111*a* may be defined by the drawer main body 110 and divider 200, and may be a space that may communicate with the outside through the inlet port 114. That is, a seating part (or seat) 113*a* on which the inlet port 114 and the fan housing 70 are installed may be formed in the rear surface of the drawer main body 110 defining the second space part 111*b*.

The second cover 140 may include a communication part (or communication port) 148 guiding the cooling air which is flowing in the cooling air path 120*a* to flow into the interior of the drawer main body 110. The communication part 148 may be an inlet hole in which at least a portion of the second cover main body 141 is cut and which introduces the cooling air into the storage space 111 of the drawer main body 110. The communication part 148 may also be formed between the guide surface 146 forming the cooling air path 120*a* and one surface of the second cover 140 forming the air bound 120*b*.

The second cover 140 may further include a stepped part (or step) 147 which is formed to be stepped downward from the guide surface 146. The stepped part 147 may be configured to extend toward the communication part 148 from the guide surface 146. The communication part 148 may be formed on one end of the stepped part 147, and may be placed adjacent to one side of the coupling parts 132 and 149.

Cooling air flowing along the guide surface 146 may pass the stepped part 147, flow downward by switching a flow direction, and may be inserted into the storage space 111 of the drawer main body 110 via the communication part 148.

According to the configuration, while the cooling air discharged from the outlet port 72 passes through the guide surface 146, the stepped part 147, and the communication part 148, the flow direction may be switched so that the cooling air may be introduced into the storage space 111 of the drawer main body 110. Since the guide surface 146, the stepped part 147, and the communication part 148 may cause the cooling air to flow toward the center of the drawer main body 110 from a side of the drawer main body 110, the cooling air may be effectively circulated through the entire area of the storage space 111.

Seating parts 113*a* and 113*b* which are recessed in a predetermined direction may be formed at the rear surface of the drawer main body 110. Specifically, the seating parts 113*a* and 113*b* may include a first seating part (or first seat) 113*a* which supports at least a part of the fan housing 70, and a second seating part (or second seat) 113*b* on which a temperature sensor 180 may be seated. The first seating part 113*a* may be formed to be recessed downward from an upper portion of the rear surface of the drawer main body 110, and the second seating part 113*b* may be formed to be further recessed laterally from the first seating part 113*a*.

The inlet port 114 through which the cooling air in the storage space 111 is discharged may be formed at the rear surface of the drawer main body 110. The inlet port 114 may be formed at a lower side of the seating parts 113*a* and 113*b*. The seating parts 113*a* and 113*b* may be formed in a rear upper portion of the drawer main body 110, and the inlet port 114 may be formed in a rear lower portion of the drawer main body 110.

Since the seating parts 113*a* and 113*b* may be formed with the rear surface of the drawer main body 110, the cooling air in the first space part 111*a* may circulate smoothly. Specifically, the drawer main body 110 may include a rear surface, a lower surface and first and second side surfaces. Cooling air may flow into the cooling air duct 120 through the rear surface and may be inserted into the first space part 111*a* via the communication part 148. In this process, the cooling air may flow toward the divider 200 and may circulate throughout the first space part 111*a*. The cooling air circulated in the first space part 111*a* may then flow toward the rear surface of the drawer main body 110 and may be released from the drawer main body 110 through the inlet port 114.

The divider 200 dividing the storage space 111 may be provided in the drawer main body 110. The divider 200 may divide the storage space 111 into a left and a right. The divider 200 may have a surface corresponding to lower and rear surfaces of the drawer main body 110 and an inner surface of the front cover 150.

The storage space 111 may include the first space part 111*a* formed on a first side of the divider 200 and the second space part 111*b* formed on a second side of the divider 200. The first space part 111*a* and the second space part 111*b* may be understood as independent spaces which are controlled to different temperatures from each other.

The first space part 111*a* may be a space to which the cooling air flowed through the cooling air path 120*a* is supplied, i.e., a space which is in communication with the outlet port 72, and the second space part 111*b* may be a space to which separate cooling air is not supplied, and which is indirectly cooled by a temperature of the first space part 111*a* or a temperature of the refrigerator compartment 12 nearby. The first space part 111*a* may be controlled to have a temperature of about −2° C., and meat or fish may be kept in the first space part 111*a*. The second space part 111*b* may be controlled to have a temperature of about 0~2° C. and vegetables or other refrigerated foods may be kept in the second space part 111*b*.

The divider 200 may have a plate shape having upper, lower, front and rear surfaces. A lower surface of the divider 200 may be in contact with the bottom surface of the drawer main body 110, and the upper surface of the divider 200 may be in contact with the cooling air duct 120 and the top cover 160. The front surface of the divider 200 may be in contact with the front cover 150, and the rear surface of the divider 200 may be in contact with the rear surface of the drawer main body 110.

The divider 200 may be movable inside the drawer main body 110. The drawer 100 may include a guide machine for guiding movement of the divider 200. The guide machine may be installed on the rear and front cover of the drawer main body 110. The guide machine may include a guide groove 117, a contact guide surface 118 and a supporting device (or support) 119.

When the divider 200 is moved, the guide groove 117 may guide the divider 200 to be easily moved in the horizontal direction without shaking, and a guide device 290 provided on the divider 200 may be coupled to the guide groove 117. At least a portion of the guide device 290 may be configured to be inserted into the guide groove 117. The guide groove 117 may be formed on the rear surface of the drawer main body 110 and the inner surface of the front cover 150.

The contact guide surface 118 may be in contact with at least a portion of the divider 200. A roller device (or roller) 280 provided on the divider 200 may be in contact with the contact guide surface 118. When the divider 200 is moved, the roller device 280 may be rolled along the contact guide surface 118.

The contact guide surface 118 may be formed on the rear surface of the drawer main body 110 and the inner surface of the front cover 150. A plurality of contact guide surfaces 118 may be respectively provided in the rear surface of the drawer main body 110 and the front cover 150, and may be arranged vertically.

The supporting device 119 may be provided at one or more points of the contact guide surface 118. A plurality of supporting devices 119 may be provided and the plurality of the supporting devices 119 may be installed apart from each other horizontally, or in a direction of the divider 200. Based on the horizontal direction, the plurality of supporting devices 119 may include a first supporting device (or first support) 119*a* provided in a center portion of the first drawer main body 110, a second supporting device (or second support) 119*b* spaced apart in a first direction from the first supporting device 119*a* and a third supporting device (or third support) 119*c* spaced apart in a second direction from the first supporting device 119*a*.

As described above, since the contact guide surface 118 is provided vertically of the rear surface of the drawer main body 110 and the inner surface of the front cover 150, respectively, the first to third supporting devices 119*a*, 119*b* and 119*c* may also be provided vertically on each side. The first to third supporting devices 119*a*, 119*b* and 119*c* may support the divider 200 to fix the divider 200 to a predetermined position, when the divider 200 is moved to the predetermined position.

When the divider 200 is supported by the first supporting device 119*a*, the divider 200 may divide the storage space 111 so that the sizes of the first space part 111*a* and the second space part 111*b* are substantially the same. When the divider 200 supported by the second supporting device 119*b*, the divider 200 may divide the storage space 111 to make the size of the first space part 111*a* smaller than the size of the second space part 111*b*. When the divider 200 supported by the third supporting device 119*c*, the divider 200 may divide the storage space 111 to make the size of the second space part 111*b* smaller than the size of the first space part 111*a*.

Figure 15:
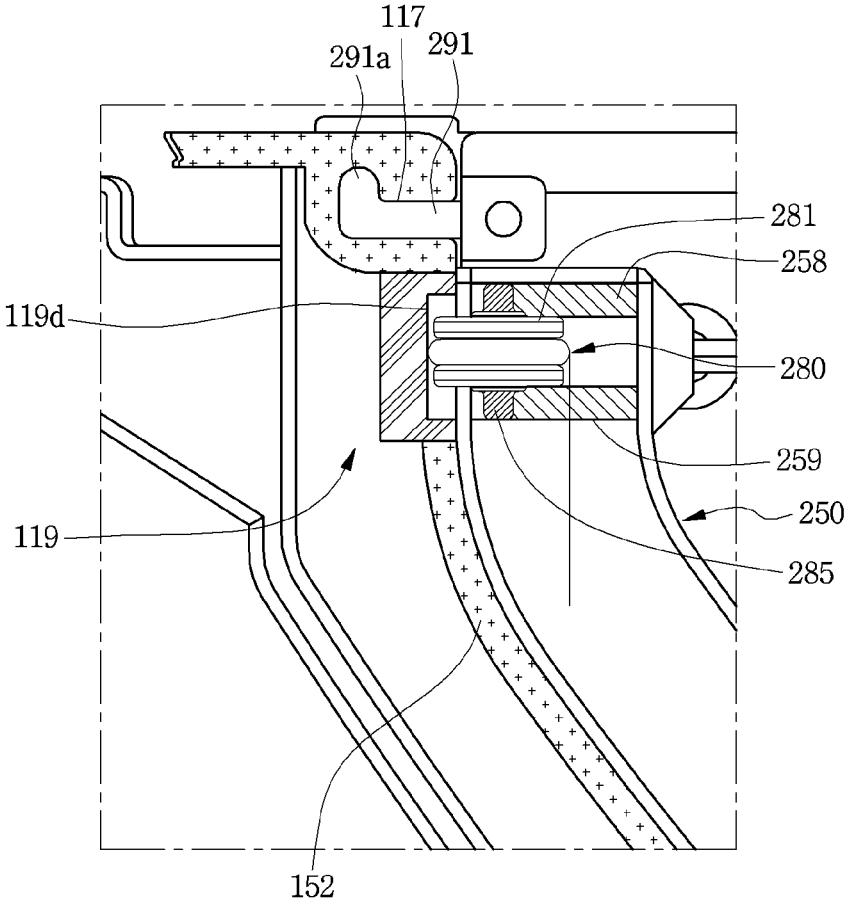
FIGS. 15 and 16 are cross-sectional views illustrating the first sealer in close contact with an inner surface of the front cover according to an embodiment.
Figure 16:
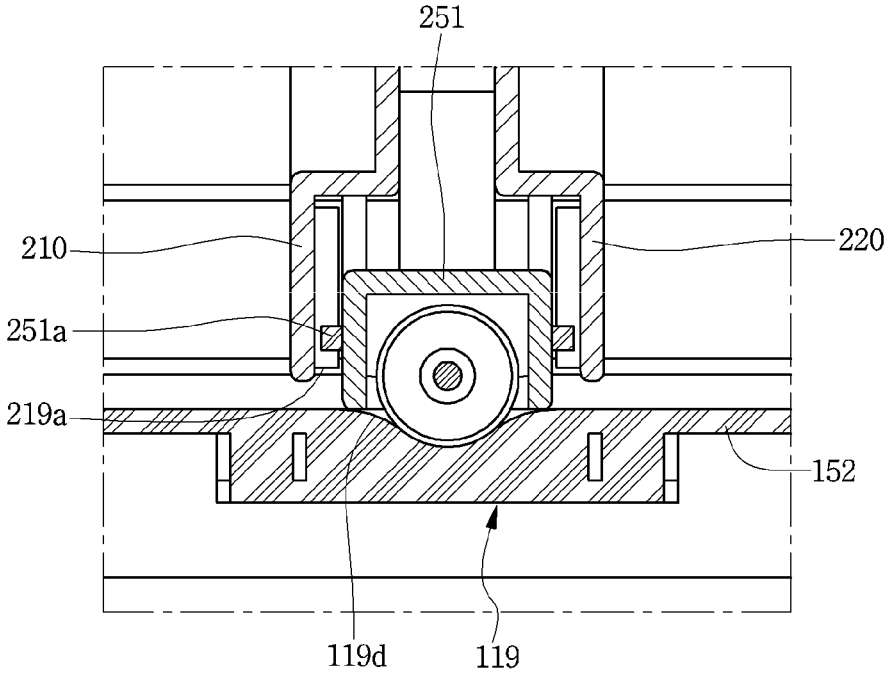

As seen in FIG. 15, a receiving groove 119*d*, receiving at least one portion of the roller device 280 may be formed in the supporting device 119. When the divider 200 is moved, the roller device 280 may reach the supporting device 119, and at least a portion of the roller device 280 may be inserted in the receiving groove 119*d*. The divider 200 may then be in close contact with the inner surface of the front cover 150 or the rear surface of the drawer main body 110.

Figure 10:
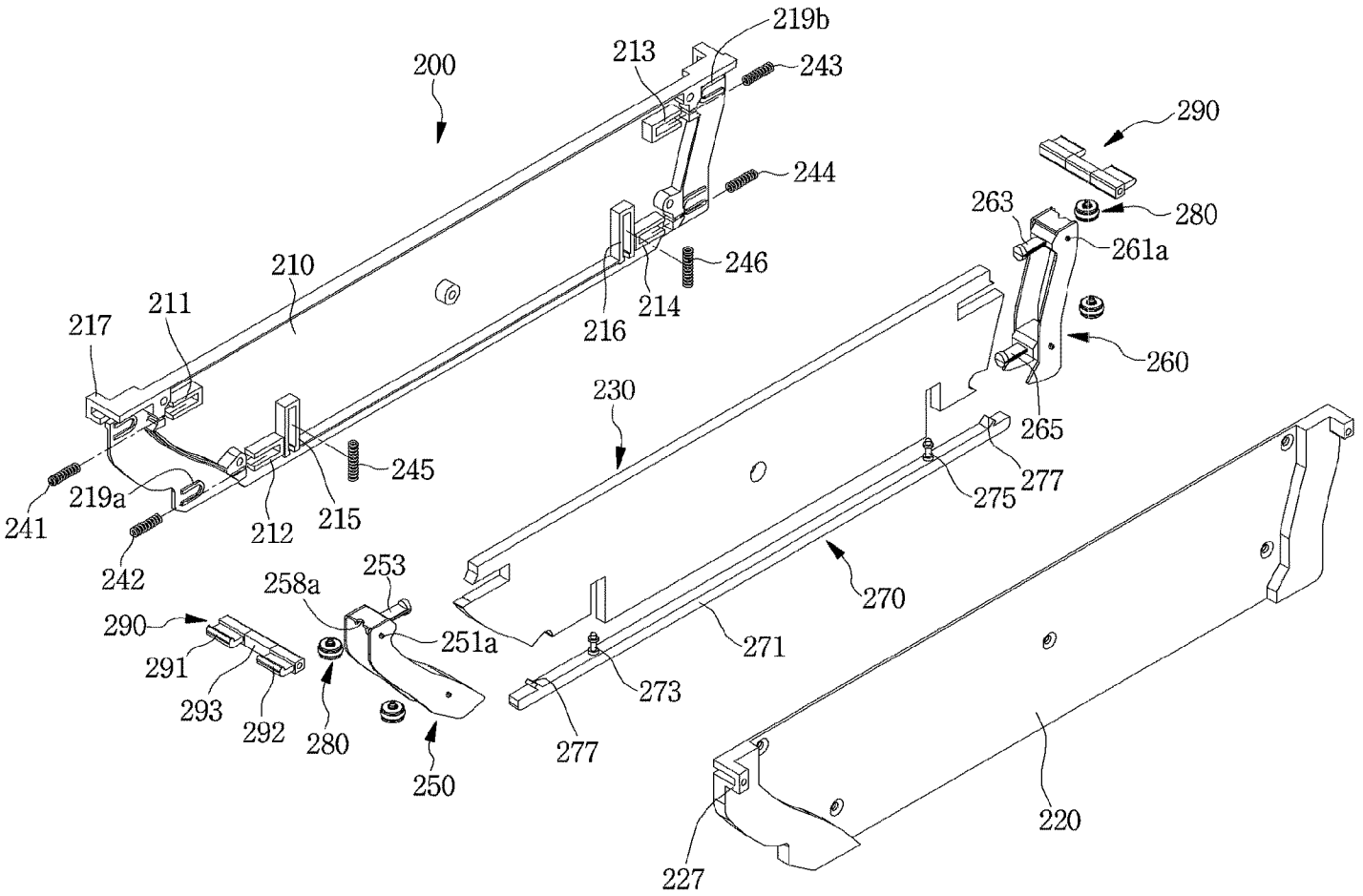
FIG. 10 is an exploded perspective view illustrating a configuration of the divider according to an embodiment.
Figure 11:
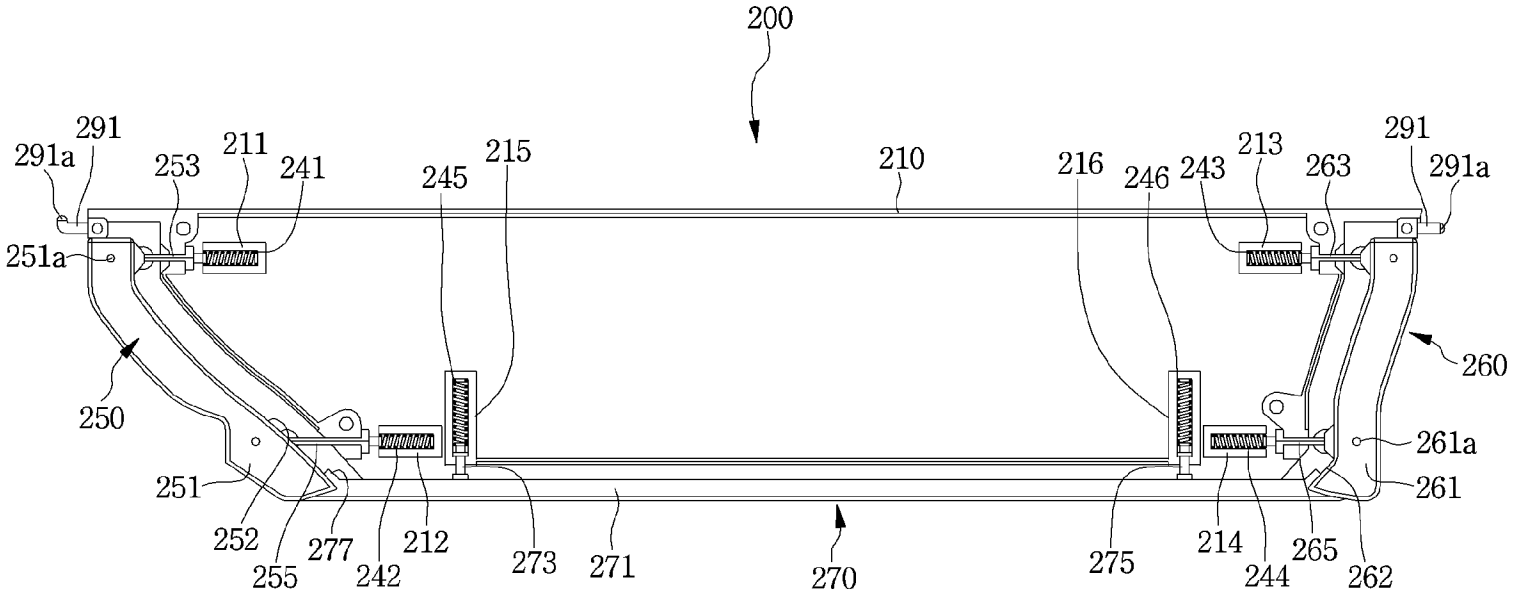
FIG. 11 illustrates a combination of a first main body of the divider and a sealer according to an embodiment.
Figure 12:
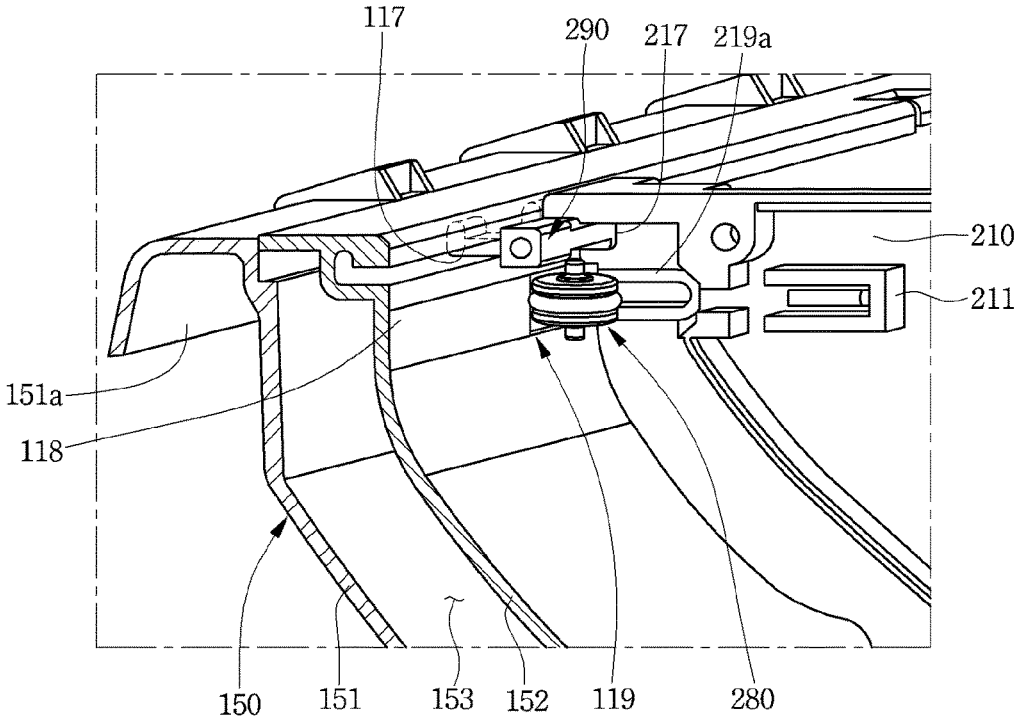
FIG. 12 illustrates a relative arrangement of a roller device of the divider and a front cover according to an embodiment.
Figure 13:
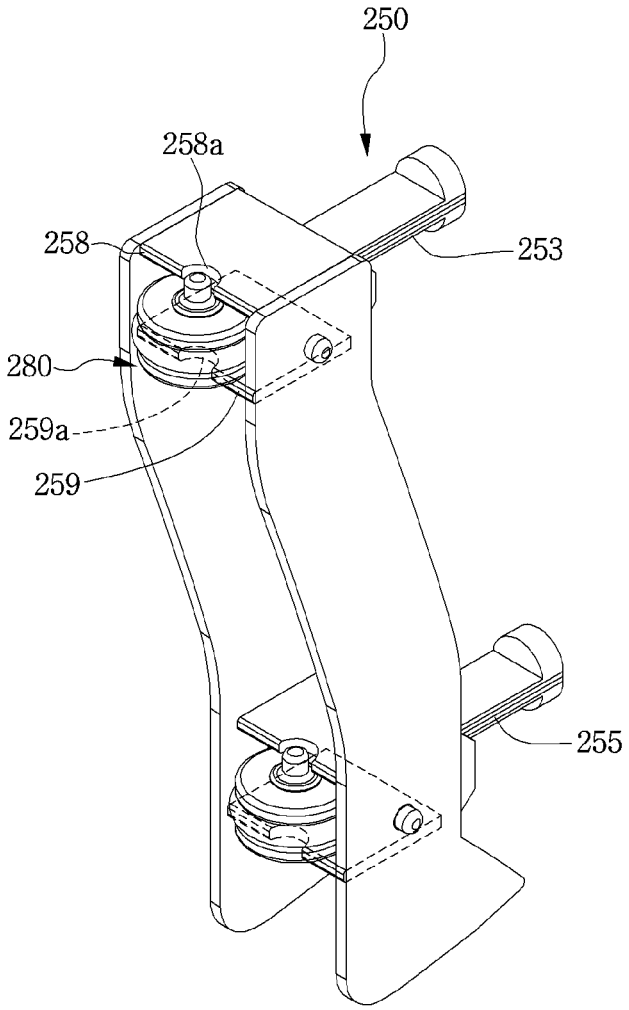
FIG. 13 illustrates the roller device installed at a first sealer according to an embodiment.
Figure 14:
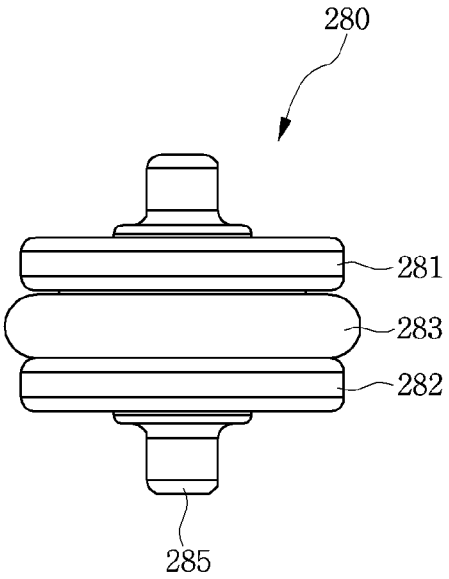
FIG. 14 illustrates a configuration of the roller device according to an embodiment.

Referring to FIGS. 10 and 11, the divider 200 may include divider main bodies 210 and 220 and an insulator 230 provided between the divider main bodies 210 and 220. The divider main bodies 210 and 220 may be configured to have an outer surface corresponding to the inner surface of the combined structure of the drawer main body 110 and the front cover 150.

An upper surface of each of the divider main bodies 210 and 220 may extend linearly corresponding to the lower surface of the cooling air duct 120, and a lower surface of each of the main bodies 210 and 220 may extend linearly corresponding to the lower surface of the drawer main body 110. The upper and lower surfaces of the divider main bodies 210 and 220 may extend parallel to each other.

A front surface of each of the divider main bodies 210 and 220 may extend obliquely toward the upper surface from the lower surface to correspond to the inner surface of the front cover 150. A rear surface of each of the divider main bodies 210 and 220 may extend in a substantially vertical direction to correspond to the rear surface of the drawer main body 110.

The divider main bodies 210 and 220 may include a first main body 210 which forms one surface of the divider main bodies 210 and 220 and a second main body 220 which is coupled to one side of the first main body 210 and forms the other surface of the divider main bodies 210 and 220. The insulator 230 may prevent heat transfer between the first and second space parts 111*a* and 111*b*, and may be styrofoam. By the configuration of the insulator 230, independent temperature control of the first and second space parts 111*a* and 111*b* may be facilitated.

The divider 200 may further include sealer devices (or sealers) 250, 260, and 270 for the divider main bodies 210 and 220 to be in contact with the inner surface of the drawer main body 110. The sealer devices 250, 260, and 270 may include a first sealer 250 installed on the front surface of the divider main bodies 210 and 220, a second sealer 260 installed on the rear surface, and a third sealer 270 installed on the lower surface.

The first to third sealers 250, 260, and 270 may be movable. When the divider 200 is supported on the supporting device 119, the first to third sealers 250, 260, and 270 may be in contact with the inner surface of the front cover 150, the rear surface of the drawer main body 110, and the lower surface of the drawer main body 110. The inner surface of the front cover 150, the rear surface of the drawer main body 110, and the lower surface of the drawer main body 110 may be collectively named as a contact surface. When the divider 200 is moving, the first to third sealers 250, 260, and 270 may be moved in a direction away from the contact surfaces.

The divider 200 may further include a plurality of resilient members providing a restoring force to the first to third sealers 250, 260, and 270. The plurality of resilient members may include a compression spring. The plurality of resilient members may include a first resilient member (or first spring) 241 and a second resilient member (or second spring) 242 providing a restoring force to the first sealer 250. The first resilient member 241 may be provided on or at an upper side of the first sealer 250, and the second resilient member 242 may be provided on or at a lower side of the first sealer 250. The first and second resilient members 241 and 242 may be collectively named as a first sealer resilient member.

The plurality of resilient members may include a third resilient member (or third spring) 243 and a fourth resilient member (or fourth spring) 244 which provide a restoring force to the second sealer 260. The third resilient member 243 may be provided on or at an upper side of the second sealer 260, and the fourth resilient member 244 may be provided on or at a lower side of the second sealer 260. The third and fourth resilient members 234 and 244 may be collectively named as a second sealer resilient member.

The plurality of resilient members may include a fifth resilient member (or fifth spring) 245 and a sixth resilient member (or sixth spring) 246 which provide a restoring force to the third sealer 270. The fifth resilient member 245 may be provided on or at a front portion side of the third sealer 270, and the sixth resilient member 246 may be provided on or at a rear portion side of the third sealer 270. The fifth and sixth resilient members 245 and 246 may be collectively named as a third sealer resilient member.

The first main body 210 may include a plurality of mounting parts which have a plurality of resilient members. Each of the mounting parts may be formed by a depression including a receiving area where the resilient members may be received.

The plurality of mounting parts may include a first mounting part (or first slot) 211 on which the first resilient member 241 is installed and a second mounting part (or second slot) 212 in which the second resilient member 242 is installed. The first mounting part 211 may be provided in a front upper portion of the first main body 210 and the second mounting part 212 may be provided in a front lower portion of the first main body 210.

The plurality of mounting parts may include a third mounting part (or third slot) 213 in which the third resilient member 243 is installed and a fourth mounting part (or fourth slot) 214 in which the fourth resilient member 244 is installed. The third mounting part 213 may be provided in a rear upper portion of the first main body 210 and the fourth mounting part 214 may be provided in a rear lower portion of the first main body 210.

The plurality of mounting parts may include a fifth mounting part (or fifth slot) 215 in which the fifth resilient member 245 is installed and a sixth mounting part (or sixth slot) 216 in which the sixth resilient member 246 is installed. The fifth mounting part 215 may be provided in the front of the first main body 210 and the sixth mounting part 216 may be provided in the rear of the first main body 210.

The first sealer 250 may include a first sealer main body 251 at which the roller device 280 is installed and resilient coupling parts 253 and 255 extending from the rear of the first sealer main body 251 and coupled to the first and second resilient members 241 and 242. The resilient coupling parts 253 and 255 may include a first resilient coupling part (or first resilient coupler) 253 provided in an upper portion of the first sealer main body 251 and a second resilient coupling part (or second resilient coupler) 255 provided in a lower portion of the first sealer main body 251.

A first side portion of the first resilient member 241 may be coupled to the first resilient coupling part 253 and a second side portion of the first resilient member 241 may be coupled to the first mounting part 211. A first side portion of the second resilient member 242 may be coupled to the second resilient coupling part 255 and a second side portion of the second resilient member 242 may be coupled to the second mounting part 212.

The first sealer main body 251 may include a first inclined surface 252 that forms a rear surface of the first sealer main body 251. The first inclined surface 252 may press the third sealer 270 when the first sealer main body 251 is moved away from the front cover 150.

A push rib 277 acting with the first inclined surface 252 may be provided on the front part of the third sealer 270. The third sealer 270 may include a third sealer main body 271 which may be in contact with the lower surface of the drawer main body 110. The push rib 277 may be provided in a front portion of the third sealer main body 271 and may project upward from an upper surface of the third sealer main body 271.

The push rib 277 may also be provided in a rear portion of the third sealer main body 271, and the push rib 277 at the rear portion may act with a second inclined surface 262 of the second sealer 260. The push rib 277 at the rear portion may be pressed by the second inclined surface 262. The push rib 277 acting with the first sealer 250 may be named as a first push rib, and the push rib 277 acting with the second sealer 260 may be named as a second push rib.

The second sealer 260 may include a second sealer main body 261 at which the roller device 280 may be installed and resilient coupling parts 263 and 265 extending from the front of the second sealer main body 261 and coupled to the third and fourth resilient members 243 and 244. The resilient coupling parts 263 and 265 may include a third resilient coupling part (or third resilient coupler) 263 provided in an upper portion of the second sealer main body 261 and a fourth resilient coupling part (or fourth resilient coupler) 265 provided in a lower portion of the second sealer main body 261.

A first side portion of the third resilient member 243 may be coupled to the third resilient coupling part 263 and a second side portion of the third resilient member 245 may be coupled to the third mounting part 213. A first side portion of the fourth resilient member 244 may be coupled to the fourth resilient coupling part 265 and a second side portion of the fourth resilient member 244 may be coupled to the fourth mounting part 214.

The third sealer 270 may include resilient coupling parts 273 and 275, extending upward from the third sealer main body 271 and coupled to the fifth and sixth resilient members 245 and 246. The resilient coupling parts 273 and 275 may include a fifth resilient coupling part (or fifth resilient coupler) 273 provided in a front portion of the third sealer main body 271 and a sixth resilient coupling part (or sixth resilient coupler) 275 provided in a rear portion of the third sealer main body 271.

A first side portion of the fifth resilient member 245 may be coupled to the fifth resilient coupling part 273 and a second side portion of the fifth resilient member 245 may be coupled to the fifth mounting part 215. A first side portion of the sixth resilient member 246 may be coupled to the sixth resilient coupling part 275 and a second side position of the sixth resilient member 246 may be coupled to the sixth mounting part 216.

A guide rib to guide the movement of each sealer may be provided on the first sealer 250 and the second sealer 260. In detail, the first sealer 250 may include a first guide rib 251*a* which is provided on both side surfaces of the first sealer main body 251. The first guide rib 251*a* may be provided at each of lower and upper portions of both side surfaces of the first sealer main body 251.

The second sealer 260 may include a second guide rib 261*a* which is provided on both side surfaces of the second sealer main body 261. The second guide rib 261*a* may be provided at each of lower and upper portions of the both side surfaces of the second sealer main body 261.

A first rib coupling part (or first rib coupler) 219*a* which is coupled with the first guide rib 251*a* may be provided on the first main body 210 and the second main body 220. The first rib coupling part 219*a* may be provided in each of the front upper and lower portions of the first and second main bodies 210 and 220. When the first sealer 250 is moving, the first guide rib 251*a* may move in the first rib coupling part 219*a*.

A second rib coupling part (or second rib coupler) 219*b* which is coupled with the second guide rib 261*a* may be provided on the first main body 210 and the second main body 220. When the second sealer 260 is moving, the second guide rib 261*a* may move in the second rib coupling part 219*b*. Since each of the first guide rib 251*a* and the second guide rib 261*a* may move while being inserted to the first rib coupling part 219*a* and the second rib coupling part 219*b* respectively, the movement of the first sealer 250 and the second sealer 260 may be performed stably.

The roller device 280 may be installed inside the first sealer main body 251 and the second sealer main body 261. A plurality of roller devices 280 may be installed on the first sealer main body 251 and the second sealer main body 261. The plurality of roller devices 280 may be installed on the upper and lower portions of the each sealer main body.

The divider 200 may further include the guide device 290 guiding the movement of the divider 200. The guide device 290 may be provided in the front portion and the rear portion of the divider 200 and may be coupled to the divider main bodies 210 and 220. The guide device 290 may be installed to move along the guide groove 117 formed on the rear surface of the drawer main body 110 and the inner surface of the front cover 150.

The divider main bodies 210 and 220 may include guide coupling parts 217 and 227 coupled with the guide device 290. A first guide coupling part (or first guide coupler) 217 coupled with at least a portion of the guide device 290 may be provided in the front portion of the first main body 210. The second guide coupling part (or second guide coupler) 227 coupled with another portion of the guide device 290 may be provided in the front portion of the second main body 220. The first guide coupling part 217 and the second guide coupling part 227 may have a shape of a groove, depressed in a first direction and a second direction respectively.

The guide device 290 may include a first part (or first tab) 291 inserted into the first guide coupling part 217, a second part (or second tab) 292 inserted into the second guide coupling part 227, and a connecting part (or connector) 293 provided between the first and second parts 291 and 292, and connecting the first and second parts 291 and 292. At least a portion of the connecting part 293 may be inserted into the first guide coupling part 217 or the second guide coupling part 227.

The guide device 290 may further include a hook 291*a* bent from the first part 291 and the second part 292. The hook 291*a* may be inserted into the guide groove 117. The guide groove 117 may be formed to be bent in an approximately ⌙ shape, so that at least one portion of the first and second parts 291 and 292 and the hook 291*a* may be inserted therein. The hook 291*a* may prevent the guide device 290 from disengaging from the guide groove 117.

Referring to FIGS. 12 to 16, the front cover 150 may include an outer plate 151 having a handle 151*a*, an inner plate 152 coupled to the inside of the outer plate 151, and an air bound (or air buffer layer) 153 formed between the outer plate 151 and inner plate 152. The air bound 153 improves the insulating effect against the outside of the drawer 100. The contact guide surface 118 may be in contact with the roller device 280 in a rolling manner, and the supporting device 119 provided in the contact guide surface 118 and may support the roller device 280 when the divider 200 is fixed at a predetermined position. The contact guide surface 118 and the supporting device 119 may be provided in the inner plate 152.

The contact guide surface 118 may be provided at each of upper and lower portions of the inner plate 152. The guide groove 117 may be formed in the contact guide surface 118. The supporting device 119 may be coupled to the guide groove 117.

The receiving groove 119*d* which receives at least one portion of the roller device 280 may be formed in the supporting device 119. The receiving groove 119*d* may be configured to be depressed in a direction toward the outer plate 151 from the inner plate 152.

Although the supporting device 119 may be provided in the inner plate 152, the receiving groove may be formed directly in the inner plate 152. A plurality of roller devices 280 may be installed in the first sealer main body 251 of the first sealer 250. A receiving space having the plurality of roller devices 280 may be formed in the first sealer main body 251.

In detail, the first sealer 250 may further include supporting parts 258 and 259 supporting each roller device 280. The supporting parts 258 and 259 may be coupled to an inner side of the first sealer main body 251. The supporting parts 258 and 259 may include a first supporting part (or first support) 258 placed in an upper side of the roller device 280 and a second supporting part (or second support) 259 placed in a lower side of the roller device 280.

The roller device 280 may include a first roller 281, a second roller 282 and a ring member (or ring) 283 which is placed between the first and second rollers 281 and 282. The second roller 282 may be installed on a lower side of the first roller 281. The ring member 283 may be a soft material and the first and second rollers 281 and 282 may move smoothly by the ring member 283.

The roller device 280 may further include a roller center part (or roller axle) 285 providing a center of rotation of the roller device 280. The roller center part 285 may be installed to pass through the first and second rollers 281 and 282 and the ring member 283.

An upper portion of the roller center part 285 may protrude toward an upper side of the first roller 281 and may be inserted into the first supporting part 258. A lower portion of the roller center part 285 may protrude toward a lower side of the second roller 282 and may be inserted into the second supporting part 259.

The first supporting part 258 may include a first coupling part (or first coupler) 258*a* to which the upper portion of the roller center part 285 is coupled. The second supporting part 259 may include a second coupling part (or second coupler) 259*a* to which the lower portion of the roller center part 285 is coupled.

Figure 17:
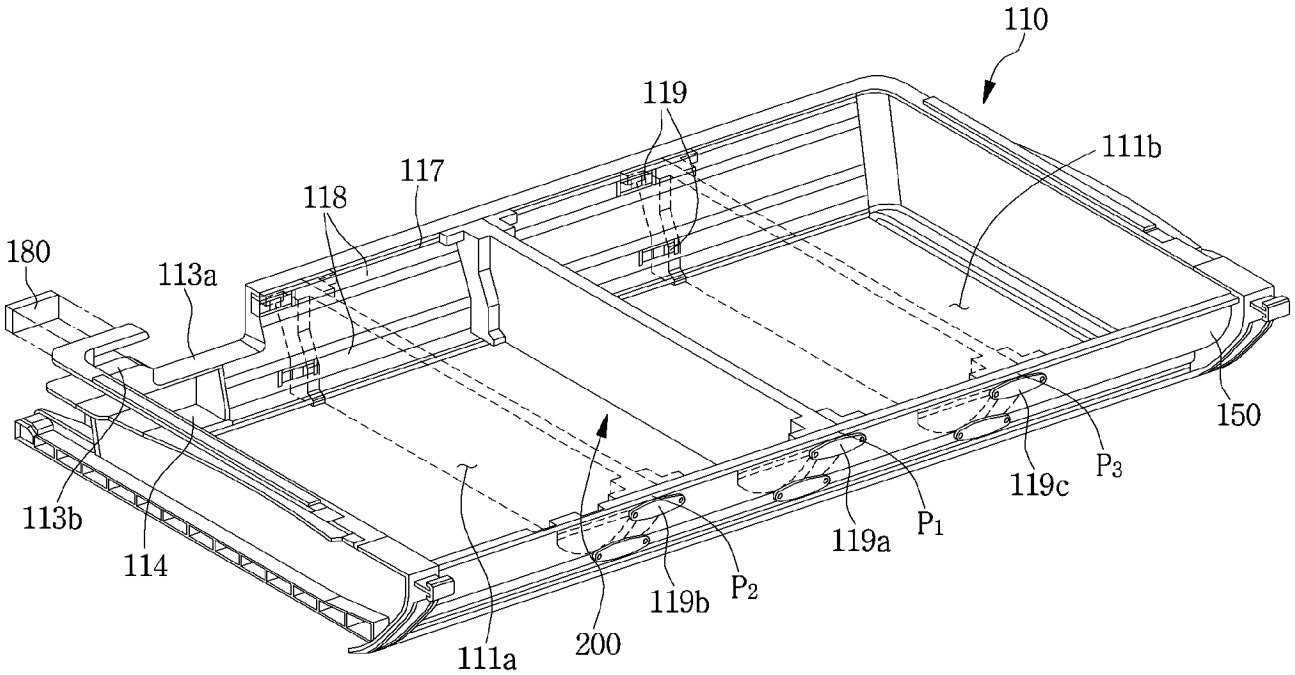
FIG. 17 illustrates the divider moved in the drawer main body according to an embodiment.

Referring to FIG. 17, when the divider 200 is placed at a first setting position P1 of the drawer main body 110, the storage space 111 inside the drawer main body 110 may be divided into the first and second space parts 111*a* and 111*b* which may be approximately equal in size. The first setting position P1 may form a substantially middle point of the left and right width of the drawer main body 110.

The user may move the divider 200 to a left side or right side. The user may move the divider 200 to the left side and may place the divider 200 at a second setting position P2 of the drawer main body 110. When the divider 200 is placed at the second setting position P2, the size of the second space part 111*b* may be larger than the size of the first space part 111*a*. The size of the second space part 111*b* may form 75% of the storage space 111 and the size of the first space part 111*a* may form 25% of the storage space 111.

The user may move the divider 200 to the right side and may place the divider 200 at a third setting position P3 of the drawer main body 110. When the divider 200 is placed in the third setting position P3, the size of the first space part 111*a* may be formed larger than the size of the second space part 111*b*. The size of the first space part 111*a* may form 75% of the storage space 111 and the size of the second space part 111*b* may form 25% of the storage space 111.

When the divider 200 is placed at the first setting position P1, the second setting position P2 or the third setting position P3, at least a portion of the roller device 280 may be inserted into the receiving groove 119*d* of the supporting device 119, and accordingly, the divider 200 may be in contact or seated with the inner surface of the front cover 150 or the rear surface of the drawer main body 110.

When the user applies a force to the divider 200 to move the divider 200, the divider 200 may be moved to the left or right side. When the divider 200 starts to move, the roller device 280 may be moved along a surface of the receiving groove 119*d*, and the first sealer 250 and the second sealer 260 coupled with the roller device 280 may move away from the inner surface of the front cover 150 and the rear surface of the drawer main body 110. The first to fourth resilient members 241 to 244 may also be compressed.

When the first and second sealers 250 and 260 are moving, the first and second sealers 250 and 260 may press the push rib 277 of the third sealer 270, and accordingly the third sealer 270 may move upward. The third sealer 270 may thus be moved away from the lower surface of the drawer main body 110.

When the divider 200 moves, the roller device 280 may roll along the contact guide surface 118. The guide device 290 may be moved along the guide groove 117 and the divider 200 may be moved smoothly without shaking by the guide device 290. When the divider 200 is moved and reaches any of the first to third setting positions, at least a portion of the roller device 280 may be inserted into the receiving groove 119*d* of the supporting device 119, and accordingly by the restoring force of the first to fourth resilient members 241 to 244, the first and second sealers 250 and 260 may be moved toward the rear surface of the drawer main body 110 and the inner surface of the front cover 150.

Consequently, the first and second sealers 250 and 260 may be in contact with the inner surface of the front cover 150 and the rear surface of the drawer main body 110 and may separate the first and second space parts 111*a* and 111*b* to the left and right. Temperatures of the first and second space parts 111*a* and 111*b* may thus be independently controlled. Further, the sizes of the first and second space parts 111*a* and 111*b* in different environments may be adjusted, and thus the user convenience may be increased.

A refrigerator may be able to divide a storage space of a drawer, and to provide storage compartments having different temperatures from each other. The refrigerator may include a cabinet configured to form a storage compartment; a rear panel configured to form a rear wall of the storage compartment and have a cooling air outlet hole for discharging cooling air toward the storage compartment; a fan housing configured to couple to the rear panel and install a fan for generating a circulation of the cooling air therein; an outlet port configured to be formed in the fan housing and discharging the cooling air supplied by the drive of the fan; and a drawer configured to be withdrawn forward from an inside of the storage compartment. The drawer may include a drawer main body configured to form a storage space; a divider provided movably in the interior of the drawer main body and partitioning the storage space into a first space part and a second space part; and a sealer device configured to be provided on at least one side of the divider and sealing the first and second space parts each other.

In the drawer, a front cover configured to shield the front of the drawer main body may further be included, and the divider may have a surface corresponding to a lower surface and a rear surface of the drawer main body and an inner surface of the front cover. The sealer device may include a roller device.

A contact guide surface configured to contact the roller device and guide the movement of the divider may be included in at least one of the rear surface of the drawer main body and the inner surface of the front cover. A receiving groove configured to receive at least one portion of the roller device, may be formed at the contact guide surface. A plurality of the receiving grooves may be provided spaced apart from each other.

The divider may be arranged in the positions corresponding to the plurality of receiving grooves and may adjust the size of the first and second space parts. The divider may include a supporting device configured to be inserted movably in the rear surface of the drawer main body or the inner surface of the front cover, and then when the divider is moving, prevent the shake of the divider.

The supporting device may include a part coupled to a divider main body; and a hook which is bent from the part. A guide groove in which the part and the hook are inserted may be formed on the rear surface of the drawer main body or the inner surface of the front cover.

The sealer device may include a first sealer which is provided in a front portion of the divider and may be in close contact with the inner surface of the front cover; a second sealer which is provided in a rear portion of the divider and may be in close contact with the rear surface of the drawer main body; and a third sealer which is provided in a lower portion of the divider and may be in close contact with the lower surface of the drawer main body. The divider may include a resilient member providing a restoring force to at least any of the first to third sealers.

The resilient member may include a first sealer resilient member configured to couple to one side of the first sealer and provide a restoring force in a forward direction; a second sealer resilient member configured to couple to one side of the second sealer and provide a restoring force in a rearward direction; and a third sealer resilient member configured to couple to one side of the third sealer and provide a restoring force in an upward direction.

Each of the first to third sealers may be provided so as to be movable in a direction spaced apart from the inner surface of the front cover, the rear surface of the drawer main body and the lower surface of the drawer main body. The third sealer may include a push rib pressed from the first and second sealers, and when the push rib is pressed from the first and second sealers, the third sealer moves forward.

The roller device may include a roller configured to roll; and a ring member provided on one side of the roller and guiding the movement of the divider. The divider may include a divider main body coupled with the sealer device; and an insulator which is provided in the divider main body and insulating the first and second space parts. The first space part may be provided with the cooling air discharged from the outlet port, and the second space part may be indirectly cooled by the cooling air in the first space part, and each of the first space part and the second space part may be controlled to a different temperature.

The drawer main body may have an open upper portion and further include a cooling air duct which shields at least a part of the open upper portion of the drawer main body and forms a path through which the cooling air passed through the fan flows. The cooling air duct may include a first cover; a second cover coupled to a lower side of the first cover; and a cooling air path through which the cooling air discharged from the outlet port flows and which is formed between the first cover and the second cover.

The cooling air duct may further include an air bound or buffer layer into which air partitioned with the cooling air path is inserted; a first coupling part provided on a lower surface of the first cover; and a second coupling part provided on an upper surface of the second cover, coupled to the first coupling part and partitioning the cooling air path and the air bound with the first coupling part.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet configured to form a storage compartment;

a rear panel that forms a rear wall of the storage compartment and having a cooling air outlet hole to discharge cooling air toward the storage compartment;

a fan housing coupled to the rear panel and a fan provided in the fan housing;

an outlet port formed at the fan housing to discharge the cooling air circulated by the fan; and a drawer movable in a prescribed direction from an inside of the storage compartment, the drawer including:

a drawer main body that forms a storage space, the drawer main body including a lower surface and a rear surface;

a front cover provided at a front side of the drawer main body;

a movable divider provided in the drawer main body to partition the storage space into a first space and a second space, the divider including a lower portion that faces the lower surface of the drawer main body, a rear portion that faces the rear surface of the drawer main body and a front portion that faces an inner surface of the front cover; and a plurality of seals provided on edges of the divider to seal the first and second spaces to be isolated from each other, the plurality of seals comprising:

a first seal provided at the front portion of the divider and being in contact with the inner surface of the front cover;

a first roller installed at the first seal;

a second seal provided at the rear portion of the divider and being in contact with the rear surface of the drawer main body;

a second roller installed at the second seal;

a third seal provided at the lower portion of the divider and being in contact with the lower surface of the drawer main body, wherein when the divider moves, the first to third seals move in a direction away from the inner surface of the front cover, the rear surface of the drawer main body and the lower surface of the drawer main body, respectively.

2. The refrigerator of claim 1, wherein at least one of the rear surface of the drawer main body and the inner surface of the front cover includes a contact guide surface in contact with the first or second roller, the contact guide surface being configured to guide movement of the divider.

3. The refrigerator of claim 2, wherein a receiving groove receiving at least a portion of the first or second roller is formed on the contact guide surface.

4. The refrigerator of claim 3, wherein the receiving groove includes a plurality of receiving grooves, which are spaced apart from each other.

5. The refrigerator of claim 4, wherein the divider is placed at a position corresponding to the plurality of receiving grooves, and adjusts the size of the first and second spaces.

6. The refrigerator of claim 1, wherein the divider includes a supporter which is movably inserted into the rear surface of the drawer main body or the inner surface of the front cover, and prevents shaking of the divider when the divider moves.

7. The refrigerator of claim 6, wherein the supporter includes at least one tab coupled to a divider main body and at least one hook bent from the at least one tab.

8. The refrigerator of claim 7, wherein a guide groove in which the at least one tab and the at least one hook are inserted is formed on the rear surface of the drawer main body or the inner surface of the front cover.

9. The refrigerator of claim 1, wherein the divider includes at least one spring providing a restoring force to at least one of the first to third seals.

10. The refrigerator of claim 9, wherein the at least one spring includes:

a first spring providing the restoring force forward and coupled to one side of the first seal;

a second spring providing the restoring force rearward and coupled to one side of the second seal; and a third spring providing the restoring force upward and coupled to one side of the third seal.

11. The refrigerator of claim 1, wherein each of the first to third seals is provided so as to movable in a direction away from the inner surface of the front cover, the rear surface and the lower surface of the drawer main body respectively.

12. The refrigerator of claim 11, wherein the third seal includes at least one push rib pressed by the first and second seals, and when the push rib is pressed by the first and second seals, the third seal moves upward.

13. The refrigerator of claim 1, further comprising:

a ring member that is provided on one side of each of the first and the second rollers and guides movement of the divider.

14. The refrigerator of claim 1, wherein the divider includes:

a divider main body coupled with the plurality of seals; and an insulator provided in the divider main body that insulates the first and second spaces from each other.

15. The refrigerator of claim 1, wherein the cooling air discharged from the outlet port is supplied to the first space, and the second space is indirectly cooled by the cooling air of the first space, and wherein the first space and the second space are each controlled to different temperatures.

16. The refrigerator of claim 1, wherein the drawer main body has an open upper portion, and the refrigerator further includes a cooling air duct shielding at least a portion of the open upper portion of the drawer main body and forming a path in which the cooling air passed through the fan flows.

17. The refrigerator of claim 16, wherein the cooling air duct includes:

a first cover;

a second cover coupled to a lower side of the first cover; and a cooling air path provided between the first cover and the second cover and through which the cooling air discharged from the outlet port flows.

18. The refrigerator of claim 17, wherein the cooling air duct further includes:

an air buffer layer into which air partitioned with the cooling air path is inserted;

a first coupler provided on a lower surface of the first cover; and a second coupler provided on an upper surface of the second cover and coupled to the first coupler, wherein the first and the second couplers partition the cooling air path from the air buffer layer.

* * * * *